US010435263B2

(12) United States Patent
Kurita

(10) Patent No.: US 10,435,263 B2
(45) Date of Patent: Oct. 8, 2019

(54) PAPER FEEDING DEVICE, IMAGE FORMING APPARATUS AND PAPER FEEDING METHOD

(71) Applicants: KABUSHIKI KAISHA TOSHIBA, Tokyo (JP); TOSHIBA TEC KABUSHIKI KAISHA, Tokyo (JP)

(72) Inventor: Eizo Kurita, Nagaizumi Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/158,565

(22) Filed: Oct. 12, 2018

(65) Prior Publication Data

US 2019/0039844 A1 Feb. 7, 2019

Related U.S. Application Data

(63) Continuation of application No. 15/592,770, filed on May 11, 2017, now Pat. No. 10,124,974.

(51) Int. Cl.
*B65H 3/66* (2006.01)
*B65H 3/52* (2006.01)
(Continued)

(52) U.S. Cl.
CPC ..... *B65H 7/18* (2013.01); *B65H 1/12* (2013.01); *B65H 1/14* (2013.01); *B65H 1/266* (2013.01); *B65H 3/0684* (2013.01); *B65H 3/52* (2013.01); *B65H 3/56* (2013.01); *B65H 3/66* (2013.01); *B65H 5/36* (2013.01); *B65H 7/02* (2013.01);
(Continued)

(58) Field of Classification Search
CPC ..... B65H 3/66; B65H 3/52; B65H 3/5246; B65H 3/5253; B65H 3/34; B65H 1/12; B65H 1/14; B65H 1/266; B65H 1/04; B65H 1/20
See application file for complete search history.

(56) References Cited

U.S. PATENT DOCUMENTS 5,992,993 A 11/1999 Kiyohara et al.
6,045,220 A 4/2000 Kiyohara et al.
(Continued)

FOREIGN PATENT DOCUMENTS

JP 55151449 A * 11/1980
JP 04303347 A * 10/1992
(Continued)

*Primary Examiner* — Luis A Gonzalez
(74) *Attorney, Agent, or Firm* — Kim & Stewart LLP

(57) ABSTRACT

A paper feeding device according to an embodiment includes a paper feeding cassette that holds a plurality of sheets and has a stacking surface with an angle A relative to horizontal that changes depending on a quantity of sheets stacked thereon. A pickup roller feeds the plurality of sheets from the paper feeding cassette. A separation roller separates the plurality of sheets from each other in a case where the plurality of sheets are fed from the paper feeding cassette in an overlapped state. A guide unit has a guide surface which is inclined upwards on a downstream side thereof in the transport direction of the plurality of sheets. A drive unit changed an angle B of the guide surface relative to horizontal. A control device controls the drive unit to change the angle B based on the angle A.

12 Claims, 10 Drawing Sheets

(51) Int. Cl.

| | |
|---|---|
| ***B65H 7/18*** | (2006.01) |
| ***B65H 1/12*** | (2006.01) |
| ***G03G 15/00*** | (2006.01) |
| ***B65H 7/14*** | (2006.01) |
| ***B65H 1/14*** | (2006.01) |
| ***B65H 7/02*** | (2006.01) |
| ***B65H 3/56*** | (2006.01) |
| ***B65H 1/26*** | (2006.01) |
| ***B65H 3/06*** | (2006.01) |
| ***B65H 5/36*** | (2006.01) |

(52) U.S. Cl.
CPC ..... *B65H 7/14* (2013.01); *G03G 15/6529* (2013.01); *B65H 2511/214* (2013.01); *B65H 2515/10* (2013.01); *B65H 2801/06* (2013.01)

(56) References Cited

U.S. PATENT DOCUMENTS

| | | | | |
|---|---|---|---|---|
| 9,868,599 | B2 * | 1/2018 | Okumura | B65H 3/06 |
| 10,214,374 | B2 * | 2/2019 | Machida | B65H 1/04 |
| 2014/0197591 | A1 | 7/2014 | Inoue et al. | |
| 2016/0083207 | A1 | 3/2016 | Machii et al. | |

FOREIGN PATENT DOCUMENTS

| | | | | |
|---|---|---|---|---|
| JP | H09194065 | A | | 7/1997 |
| JP | 11049392 | A | * | 2/1999 |
| JP | 2002087619 | A | | 3/2002 |
| JP | 2007099416 | A | | 4/2007 |
| JP | 2007145442 | A | | 6/2007 |
| JP | 2008120584 | A | | 5/2008 |
| JP | 2009126614 | A | | 6/2009 |
| JP | 2014009082 | A | | 1/2014 |

* cited by examiner

PAPER FEEDING DEVICE, IMAGE FORMING APPARATUS AND PAPER FEEDING METHOD

CROSS-REFERENCE TO RELATED APPLICATION

This application is a continuation of U.S. patent application Ser. No. 15/592,770, filed May 11, 2017, the entire contents of which are incorporated herein by reference.

FIELD

Embodiments described herein relate generally to a paper feeding device, an image forming apparatus, and a paper feeding method.

BACKGROUND

A paper feeding device sequentially feeds a plurality of stacked and overlapped recording mediums, such as sheets, toward a transport path. The paper feeding device includes a paper feeding cassette, a pickup roller, a pair of rollers, and an inclination unit. The paper feeding cassette accommodates the plurality of stacked and overlapped sheets. The paper feeding cassette has a stacking surface on which the sheets are placed. The pickup roller delivers the plurality of stacked and overlapped sheets in sequence toward the transport path. The pair of rollers is arranged further downstream than the pickup roller in a transport direction of the recording medium. The pair of rollers includes a paper feeding roller, and a separation roller. The inclination unit is arranged between the pickup roller and the pair of rollers in the transport direction of the recording medium. The inclination unit is fixed at a fixed position. The inclination unit has an inclined surface which is inclined upwards on the downstream side in the transport direction. The inclination unit applies frictional force from the inclined surface to the sheet which is delivered from the pickup roller.

However, if the inclination unit is fixed at the fixed position, in a case where an inclination angle of the stacking surface on which the sheet is placed is changed, an angle of the sheet when the sheet approaches the inclined surface is changed. Hereinafter, the angle when the sheet approaches the inclined surface is referred to as "approach angle to the inclined surface".

If the approach angle to the inclined surface is too large, the sheet may collide with the inclined surface, and a paper jam may occur.

On the other hand, if the approach angle to the inclined surface is too small, the frictional force of the inclined surface to the sheet is lowered. Therefore, there is a case where it is not possible to handle a plurality of overlapped sheets with the inclined surface, due to a friction coefficient between the sheets, a surface condition of the sheets or the like. In this case, if the plurality of overlapped sheets are transported to the pair of rollers, it is not possible to separate the plurality of sheets from each other by the separation roller, and an overlapped transport may occur.

DETAILED DESCRIPTION

A paper feeding device according to an embodiment includes a paper feeding cassette that holds a plurality of sheets and has a stacking surface with an angle A relative to horizontal that changes depending on a quantity of sheets stacked thereon. A pickup roller feeds the plurality of sheets from the paper feeding cassette. A separation roller separates the plurality of sheets from each other in a case where the plurality of sheets are fed from the paper feeding cassette in an overlapped state. A guide unit has a guide surface which is inclined upwards on a downstream side thereof in the transport direction of the plurality of sheets. A drive unit changed an angle B of the guide surface relative to horizontal. A control device controls the drive unit to change the angle B based on the angle A.

Hereinafter, an image forming apparatus 10 according to the embodiments will be described with reference to the drawings. In each drawing, the same signs are attached to the same configuration.

Figure 1:
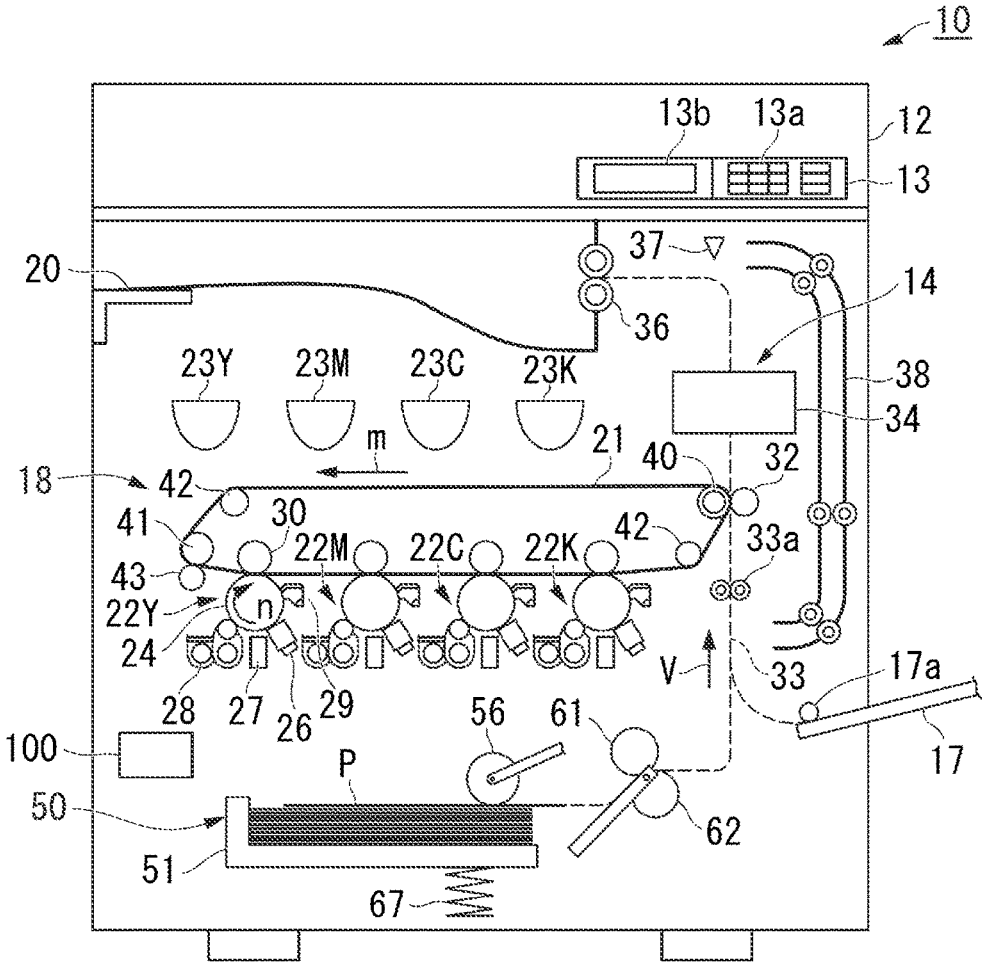
FIG. 1 is a side view illustrating an example image forming apparatus according to an embodiment.

FIG. 1 is a side view illustrating an example image forming apparatus 10 according to an embodiment. Hereinafter, the description will be made by using a multi-function peripheral (MFP) as an example of the image forming apparatus 10.

The MFP 10 includes a scanner 12, a control panel 13, and a main body unit 14. The scanner 12, the control panel 13, and the main body unit 14 are controlled by respective control units. The MFP 10 includes a system control unit 100 that manages the respective control units. The main body unit 14 includes a paper feeding device 50, a printer unit (image forming unit) 18 and the like.

The scanner 12 reads an image of an original document. The control panel 13 includes an input key 13*a*, and a display unit 13*b*. For example, the input key 13*a* accepts an input from a user. For example, the display unit 13*b* is a touch panel that accepts the input from the user, and performs a display to the user.

The paper feeding device 50 includes a paper feeding cassette 51, and a pickup roller 56. The paper feeding cassette 51 houses a sheet-shaped recording medium (referred to as a "sheet P" hereinafter) such as paper. The pickup roller 56 feeds the sheet P from the paper feeding cassette 51.

The paper feeding cassette 51 houses the unused sheet P. The paper feeding device 50 supplies the sheet P toward the printer unit 18. Alternatively, a pickup roller 17*a* can feed the unused sheet P from a paper feeding tray 17.

The printer unit 18 forms an image. For example, the printer unit 18 performs forming of an image of the original document image which is read by the scanner 12. The printer unit 18 includes an intermediate transfer belt 21. In the printer unit 18, the intermediate transfer belt 21 is supported by a backup roller 40, a driven roller 41, and a tension roller 42. The backup roller 40 includes a drive unit (not illustrated). In the printer unit 18, the intermediate transfer belt 21 rotates in a direction of an arrow m.

The printer unit 18 includes a set of four image forming stations 22Y, 22M, 22C and 22K. The image forming stations 22Y, 22M, 22C and 22K are respectively used for forming the images of Y (yellow), M (magenta), C (cyan) and K (black). The image forming stations 22Y, 22M, 22C and 22K are arranged in series along a rotation direction of the intermediate transfer belt 21, on a lower side of the intermediate transfer belt 21.

The printer unit 18 respectively includes cartridges 23Y, 23M, 23C and 23K above the image forming stations 22Y, 22M, 22C and 22K. The cartridges 23Y, 23M, 23C and 23K respectively houses toner of Y (yellow), M (magenta), C (cyan) and K (black).

Hereinafter, the description will be made by using the image forming station 22Y of Y (yellow) as an example among the image forming stations 22Y, 22M, 22C and 22K. Since the image forming stations 22M, 22C and 22K include the same configurations as that of the image forming station 22Y, the detailed description thereof will be omitted.

The image forming station 22Y includes a charger 26, an exposure scanning head 27, a developing device 28, and a photosensitive cleaner 29. The charger 26, the exposure scanning head 27, the developing device 28, and the photosensitive cleaner 29 are arranged in the vicinity of a photosensitive drum 24 which rotates in the direction of an arrow n.

The image forming station 22Y includes a primary transfer roller 30. The primary transfer roller 30 faces the photosensitive drum 24 opposite the intermediate transfer belt 21.

In the image forming station 22Y, the photosensitive drum 24 is exposed by the exposure scanning head 27 after the photosensitive drum 24 is electrified by the charger 26. The image forming station 22Y forms an electrostatic latent image on the photosensitive drum 24. The developing device 28 develops the electrostatic latent image on the photosensitive drum 24 by applying a two-component developing agent formed of a toner and a carrier.

The primary transfer roller 30 primarily transfers a toner image formed on the photosensitive drum 24 to the intermediate transfer belt 21. In similar fashion, the image forming stations 22Y, 22M, 22C and 22K forma color toner image on the intermediate transfer belt 21. A color toner image is formed by sequentially overlapping the toner images of Y (yellow), M (magenta), C (cyan) and K (black). The photosensitive cleaner 29 removes excess toner which is left on the photosensitive drum 24 after the primary transfer.

The printer unit 18 includes a secondary transfer roller 32. The secondary transfer roller 32 faces the backup roller 40 opposite the intermediate transfer belt 21. The secondary transfer roller 32 secondarily transfers the color toner images on the intermediate transfer belt 21 onto the sheet P. The sheet P is fed from the paper feeding device 50 or the paper feeding tray 17, along a transport path 33.

The printer unit 18 includes a belt cleaner 43 that faces the driven roller 41 through the intermediate transfer belt 21. The belt cleaner 43 removes the excess toner which is left on the intermediate transfer belt 21 after the secondary transfer.

The printer unit 18 includes a resistance roller 33*a*, a fixing device 34, and a paper discharging roller 36, along the transport path 33. The printer unit 18 further includes a branch unit 37, and a reverse transport unit 38 downstream of the fixing device 34. The branch unit 37 sends the sheet P, after the fixing, to the paper discharging unit 20 or the reverse transport unit 38. In case of double-sided printing, the reverse transport unit 38 reverses and transports the sheet P sent from the branch unit 37 towards the resistance roller 33*a*. In the MFP 10, the fixed toner image is formed on the sheet P by the printer unit 18, and the sheet P is discharged by the paper discharging unit 20.

The MFP 10 is not limited to the developing system described above, and the number of developing devices 28 is not limited. In the MFP 10, the toner image may be directly transferred to the sheet P from the photosensitive drum 24.

As described above, the sheet P is transported to the paper discharging unit 20 from the paper feeding device 50.

Hereinafter, in a transport direction V of the sheet P (referred to as "sheet transport direction V"), the paper feeding device 50 side is assumed to be "upstream". In the sheet transport direction V, the paper discharging unit 20 side is assumed to be "downstream".

Hereinafter, the paper feeding device 50 will be described in detail.

Figure 2:
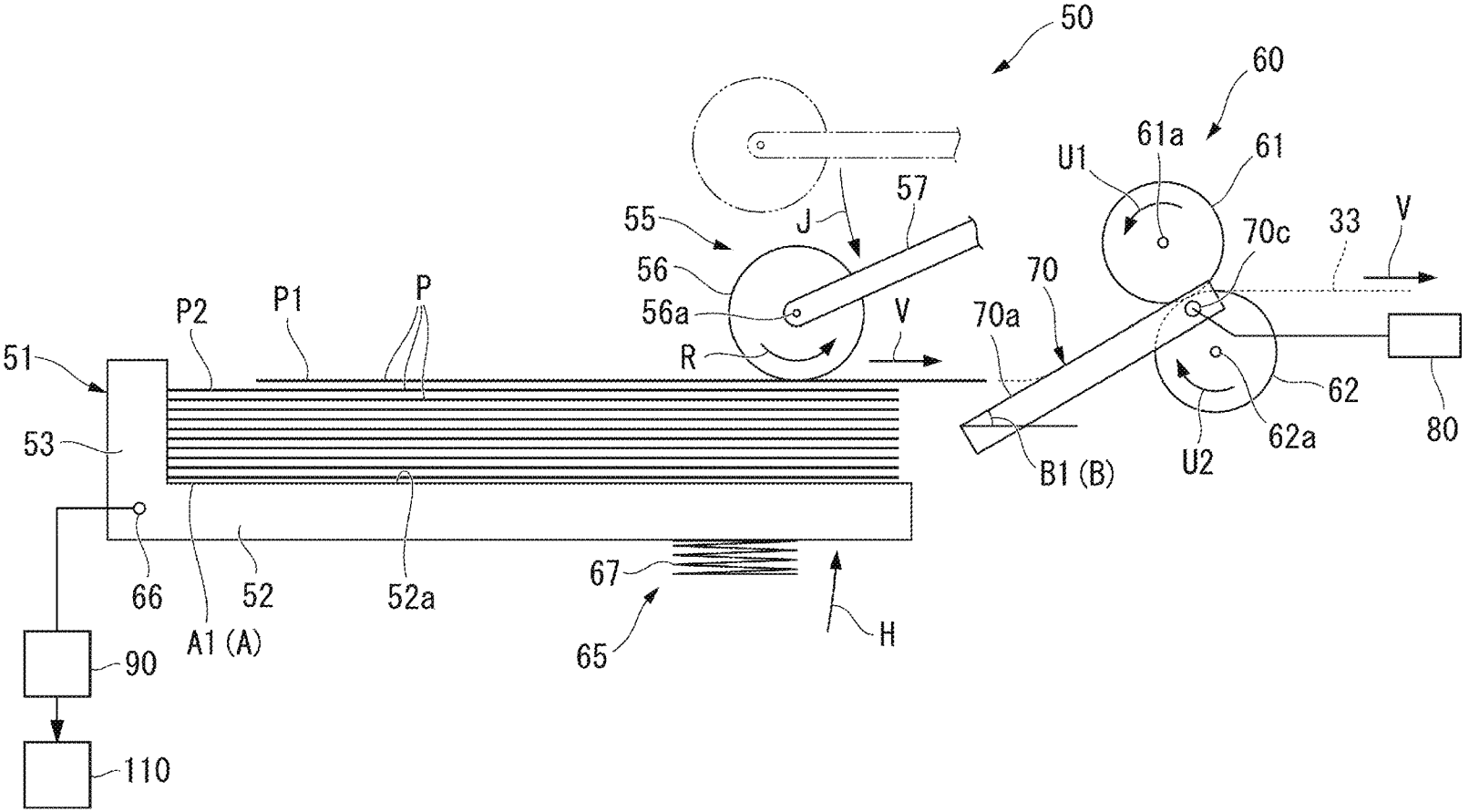
FIG. 2 is a side view illustrating an example configuration of a paper feeding device according to the embodiment.

FIG. 2 is a side view illustrating an example configuration of the paper feeding device 50 according to the embodiment.

As illustrated in FIG. 2, the paper feeding device 50 includes the paper feeding cassette 51, a delivery unit 55, a separation unit 60, a stacking surface tilting unit 65, a guide unit 70, a drive unit 80, a stacking surface angle detecting sensor 90, and a control device 110.

First, the paper feeding cassette 51 will be described.

The paper feeding cassette 51 accommodates a plurality of stacked and overlapped sheets P (which may be referred to as "stacked sheets", hereinafter). The paper feeding cassette 51 includes a bottom wall 52, and a side wall 53.

The bottom wall 52 has a stacking surface 52*a* on which the sheets are stacked. In a state of FIG. 2, the stacking surface 52*a* is a flat surface which is substantially parallel to a horizontal plane. An area of the stacking surface 52*a* is wider than that of the sheet P.

The side wall 53 is arranged in a side direction of the stacked sheets. FIG. 2 illustrates the side wall 53 which is positioned at an upstream end of the bottom wall 52. The side wall 53 extends up toward a stacked direction of the stacked sheets. A height of the side wall 53 is higher than that of the stacked sheets. The side wall 53 is arranged in the side direction of the sheet P which is delivered at first toward the transport path 33.

Next, the delivery unit 55 will be described.

The delivery unit 55 is an example of the paper feeding unit that feeds the sheet P. The delivery unit 55 delivers the plurality of stacked and overlapped sheets P in sequence toward the transport path 33. Specifically, the delivery unit 55 delivers the plurality of sheets P in sequence, starting with a sheet P1 which is positioned on the uppermost side of the stacked sheets toward the transport path 33. Hereinafter, the sheet P1 which is positioned on the uppermost side of the stacked sheets may be referred to as "first sheet P1". The first sheet P1 is the sheet that is first delivered toward the transport path 33. Hereinafter, a sheet P2 after the first sheet P1 that is delivered toward the transport path 33 may be referred to as "second sheet P2".

The delivery unit 55 includes the pickup roller 56, and a support member 57. The pickup roller 56 has a cylindrical shape. For example, the pickup roller 56 is a roller made of rubber. The pickup roller 56 enables to rotate around a support shaft 56*a* as the center thereof. Here, the support shaft 56*a* means a central shaft (rotation shaft) of the pickup roller 56. The support shaft 56*a* has a longitudinal side in the direction intersecting with the sheet transport direction V. In the embodiment, the support shaft 56*a* is substantially parallel to a horizontal direction, and has the longitudinal side substantially orthogonal to the sheet transport direction V.

The support member 57 supports the pickup roller 56 to be rotatable. The pickup roller 56 rotates in the direction of an arrow R, by being driven in accordance with a rotating body (not illustrated) such as a belt. The support member 57 is biased toward the direction of an arrow J such that the pickup roller 56 is biased toward an upper surface of the stacked sheets, by a biasing member (not illustrated) such as a spring.

For example, the support member 57 moves up and down depending on a quantity of the stacked sheets into the paper feeding cassette 51. Specifically, in a case where the paper feeding cassette 51 is empty, the support member 57 is driven upwards against biasing force of the biasing member, and causes the pickup roller 56 to not be in contact with anything. That is, in a case where the stacked sheets are not accommodated in the paper feeding cassette 51, the support member 57 is moved to the position indicated by a two-dot chain line in FIG. 2. On the other hand, in a case where the stacked sheets are accommodated in the paper feeding cassette 51, the support member 57 moves downwards (in the direction of the arrow J) by the biasing member, and causes the pickup roller 56 to be in contact with the upper surface of the stacked sheets.

Next, the separation unit 60 will be described.

The separation unit 60 is arranged downstream of the delivery unit 55 in the sheet transport direction V. The separation unit 60 separates the plurality of overlapped sheets P from each other, in a case where the plurality of sheets P delivered from the delivery unit 55 are delivered in an overlapped state.

The separation unit 60 includes a pair of rotating bodies 61 and 62 of which at least one is enabled to independently rotate. The pair of rotating bodies 61 and 62 respectively rotate around a plurality of rotation shafts 61*a* and 62*a*, which are substantially parallel to the support shaft 56*a*. The pair of rotating bodies 61 and 62 are arranged to form a portion of the transport path 33.

In the embodiment, the pair of rotating bodies 61 and 62 are a paper feeding roller 61, and a separation roller 62, respectively. The paper feeding roller 61 and the separation roller 62 face each other on opposite sides of the transport path 33. The separation roller 62 is biased towards the paper feeding roller 61, by a biasing member (not illustrated) such as a spring. The paper feeding roller 61 and the separation roller 62 each have cylindrical shapes. For example, the paper feeding roller 61, and the separation roller 62 are rollers made of rubber. Outer shapes of the paper feeding roller 61 and the separation roller 62 are the same, substantially.

The paper feeding roller 61 is arranged on an upper side of the transport path 33. The paper feeding roller 61 rotates around the first rotation shaft 61*a* which is substantially parallel to the support shaft 56*a*. Here, the first rotation shaft 61*a* means the central shaft of the paper feeding roller 61.

The separation roller 62 is arranged on a lower side of the transport path 33. The separation roller 62 rotates around the second rotation shaft 62*a* which is substantially parallel to the support shaft 56*a*. Here, the second rotation shaft 62*a* means the central shaft of the separation roller 62.

In the embodiment, the paper feeding roller 61 is a drive roller that is connected to a drive unit (not illustrated) such as a motor. The separation roller 62 is a driven roller that is in contact with the paper feeding roller 61, and is driven in accordance with the rotation of the paper feeding roller 61.

Hereinafter, rotation directions of the paper feeding roller 61 and the separation roller 62 will be described.

The paper feeding roller 61 rotates in the direction of an arrow U1, driven by the drive unit (not illustrated) such as the motor. That is, the paper feeding roller 61 rotates in the direction of the arrow U1.

In a case where the sheet P is not interposed between the paper feeding roller 61 and the separation roller 62, the separation roller 62 is driven in accordance with the paper feeding roller 61, and rotates in the direction of an arrow U2. In other words, the separation roller 62 is driven and rotates by being in contact with an outer peripheral surface of the paper feeding roller 61 which rotates in the direction of the arrow U1.

For example, in a case where a piece of sheet P (namely, the first sheet P1) is transported between the paper feeding roller 61 and the separation roller 62, the first sheet P1 is transported downstream, by the rotation of the paper feeding roller 61. At that time, the separation roller 62 is driven and rotates by being in contact with a lower surface of the first sheet P1 which is transported in the sheet transport direction V.

On the other hand, in a case where two pieces of sheets P (namely, the first sheet P1 and the second sheet P2) are transported between the paper feeding roller 61 and the separation roller 62, only the first sheet P1 is transported downstream, by the rotation of the paper feeding roller 61. If two pieces of sheets P are inserted into a nip between the paper feeding roller 61 and the separation roller 62, the drive force of the paper feeding roller 61 is not transmitted to the separation roller 62. If the drive force of the paper feeding roller 61 is not transmitted to the separation roller 62, the separation roller 62 does not rotate. If the separation roller 62 does not rotate, the first sheet P1 is in contact with the paper feeding roller 61 and so the first sheet P1 receives the force to be transported in the sheet transport direction V from the paper feeding roller 61. On the contrary, the separation roller 62 is in contact with the second sheet P2 on the lower side of the first sheet P1. The separation roller 62 is configured with an elastic member having a relatively high frictional force such as rubber. By the above configuration, the separation roller 62 performs a role of a brake such that the second sheet P2 is not transported due to frictional force from the first sheet P1. The separation roller 62 performs the role of the brake, and thereby, two pieces of sheets P are separated from each other, and the first sheet P1 is transported downstream solo.

Next, the stacking surface tilting unit 65 will be described.

The stacking surface tilting unit 65 includes a rotary movement shaft 66, and a biasing member 67. The rotary movement shaft 66 is positioned at the upstream end of the bottom wall 52 in the paper feeding cassette 51. The rotary movement shaft 66 is positioned at or near the intersection of the bottom wall 52 and the side wall 53. The rotary movement shaft 66 is substantially parallel to the support shaft 56*a*. The paper feeding cassette 51 rotates around the rotary movement shaft 66.

In the embodiment, the biasing member 67 is an elastic member that biases the paper feeding cassette 51. For example, the biasing member 67 is a coil spring. One end of the biasing member 67 is attached to the surface on the side opposite to the stacking surface 52*a* of the bottom wall 52. The other end of the biasing member 67 is attached to a bottom surface in a main body (housing) of the MFP 10 (see FIG. 1).

By the biasing member 67, the paper feeding cassette 51 is biased towards the direction of an arrow H (counter clockwise direction) at all time by using the rotary movement shaft 66 as the center of rotation. An inclination angle of the stacking surface 52*a* of the paper feeding cassette 51 is changed by a quantity of the sheet P which is placed on the stacking surface 52*a* of the paper feeding cassette 51.

Hereinafter, the quantity of the sheet P placed on the stacking surface 52*a* of the paper feeding cassette 51 is referred to as "sheet stacking quantity", the inclination angle of the stacking surface 52*a* is referred to as "stacking surface inclination angle", and a change in length of the biasing member 67 when the biasing member 67 is compressed is referred to as "compression distance". Here, the stacking surface inclination angle means an angle which is made by the stacking surface 52*a* with respect to the horizontal plane when seen from the direction along the rotary movement shaft 66.

Next, a relationship between the sheet stacking quantity and the stacking surface inclination angle will be described.

In a case where the sheet stacking quantity is larger than a predetermined quantity, the compression distance becomes relatively large due to a weight of the stacked sheets. In a case where the compression distance is relatively large, the stacking surface inclination angle becomes relatively small. In a case where the sheet stacking quantity is larger than the predetermined quantity, the paper feeding cassette rotationally moves in a reverse direction (clockwise direction) to the direction of the arrow H, around the rotary movement shaft 66 and against the biasing force of the biasing member 67. The more the sheet stacking quantity is larger than the predetermined quantity, the more the stacking surface 52*a* of the paper feeding cassette 51 is close to the horizontal plane.

On the other hand, in a case where the sheet stacking quantity is smaller than the predetermined quantity, the compression distance becomes relatively small. In a case where the compression distance is relatively small, the stacking surface inclination angle becomes relatively large. In a case where the sheet stacking quantity is smaller than the predetermined quantity, the paper feeding cassette 51 rotationally moves in the direction of the arrow H around the rotary movement shaft 66, due to the biasing force of the biasing member 67. The greater the difference between the sheet stacking quantity and the predetermined quantity, the more the stacking surface 52*a* of the paper feeding cassette 51 becomes steeper with respect to the horizontal plane.

In the state illustrated in FIG. 2, the sheet stacking quantity is the maximum. That is, in the state of FIG. 2, the compression distance becomes the maximum. Therefore, a stacking surface inclination angle A1 becomes the minimum. In the state of FIG. 2, the stacking surface inclination angle A1 is 0 degree.

Figure 3:
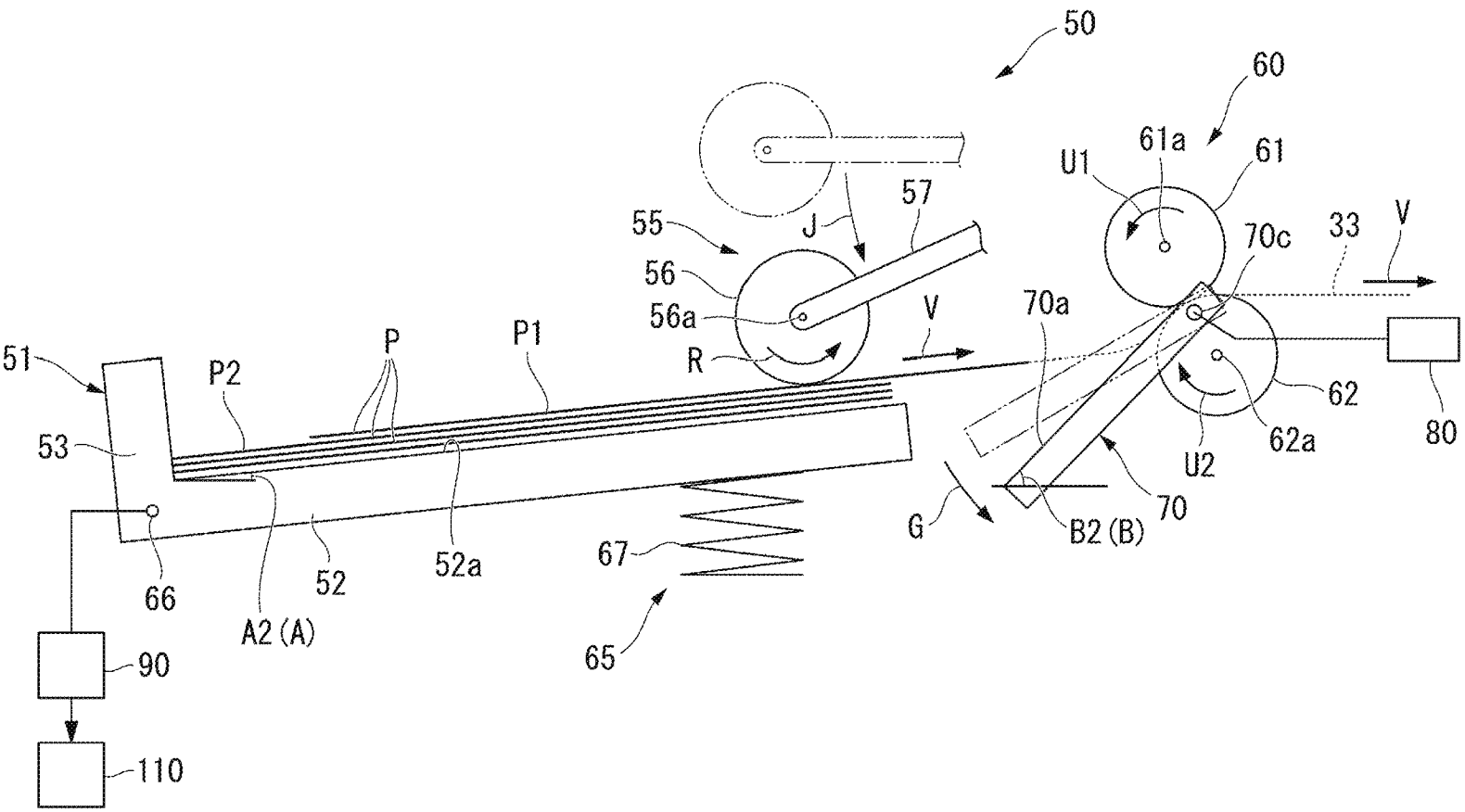
FIG. 3 is another side view of the paper feeding device illustrating an example operation of a guide unit.

FIG. 3 illustrates an example operation of the guide unit 70 according to the embodiment. In the state of FIG. 3, the sheet stacking quantity is smaller than that of FIG. 2. That is, in the state of FIG. 3, the compression distance becomes smaller than that of FIG. 2. Therefore, a stacking surface inclination angle A2 is larger than with the case of FIG. 2 (A2>A1).

Next, the guide unit 70 will be described.

As illustrated in FIG. 2, the guide unit 70 is arranged between the delivery unit 55 and the separation unit 60 in the sheet transport direction V. Specifically, the guide unit 70 is arranged between a downstream end of the bottom wall 52 and the separation unit 60 in the sheet transport direction V. The guide unit 70 has a guide surface 70*a* which is inclined upwards on the downstream side in the sheet transport direction V. The guide unit 70 is a plate-shaped member which contributes to the forming of the transport path 33. For example, the guide unit 70 is made of resin such as plastic.

Hereinafter, a rotation fulcrum 70*c* of the guide unit 70 is referred to as "guide unit fulcrum 70*c*". The guide unit fulcrum 70*c* is positioned at the downstream end of the guide unit 70. The guide unit fulcrum 70*c* is positioned to be close to the separation unit 60. The guide unit fulcrum 70*c* is overlapped with the separation roller 62 when seen from the direction along the second rotation shaft 62*a*.

Next, the drive unit 80 will be described.

The drive unit 80 enables change in the inclination angle of the guide surface 70*a*. Hereinafter, the inclination angle of the guide surface 70*a* is referred to as "guide surface inclination angle". In FIG. 2 and FIG. 3, the guide surface inclination angle is indicated by a sign B.

The drive unit 80 changes guide surface inclination angle of the guide unit 70 by using the guide unit fulcrum 70*c*. For example, the drive unit 80 is a motor. For example, rotating force of the motor is transmitted to the guide unit fulcrum 70*c* through a transmission mechanism (not illustrated) such as a gear.

Next, the stacking surface angle detecting sensor 90 will be described.

For example, the stacking surface angle detecting sensor 90 is attached to the rotary movement shaft 66 of the paper feeding cassette 51. The stacking surface angle detecting sensor 90 detects the stacking surface inclination angle of the paper feeding cassette 51. For example, the stacking surface angle detecting sensor 90 is an angle sensor. A detection result of the stacking surface angle detecting sensor 90 is output to the control device 110.

Next, the control device 110 will be described.

The control device 110 controls the drive unit 80 such that the guide surface inclination angle is changed in accordance with a change of the stacking surface inclination angle. By changing the guide surface inclination angle, the frictional force (referred to as "frictional force to the sheet", hereinafter) with respect to the sheet P delivered from the delivery unit 55 can be increased and decreased. In the embodiment, the control device 110 controls the drive unit 80 such that the guide surface inclination angle becomes large as the stacking surface inclination angle becomes large. The control device 110 controls the drive unit 80 such that a relative angle between the stacking surface inclination angle and the guide surface inclination angle remains relatively fixed.

Here, if the stacking surface inclination angle is assumed to be "A", the guide surface inclination angle is assumed to be "B", and the relative angle between the stacking surface inclination angle and the guide surface inclination angle is assumed to be "C", the following expression is made.

$$C=B-A$$

The relative angle C remains at the fixed angle, and thereby, the frictional force to the sheet is uniformly retained.

The relationship of the relative angle C and a difference (B−A) between the stacking surface inclination angle A and the guide surface inclination angle B may also substantially satisfy the expression C≈B−A.

A case where the relative angle C remains within a predetermined angle range is also included in the present embodiment. A case where the frictional force to the sheet remains within a predetermined frictional force range is also included in the present embodiment. That is, the relative angle C remains within the predetermined angle range, and thereby, the frictional force to the sheet may remain within the predetermined frictional force range, according to the embodiment.

The control device 110 controls the drive unit 80 such that the guide surface inclination angle is a first inclination angle B1 (see FIG. 2) when the stacking surface inclination angle is smaller than a stacking surface angle threshold which is previously set, based on the detection result of the stacking surface angle detecting sensor 90. Here, the stacking surface angle threshold is set to be equal to or less than an angle of a case where an overlapped transport or a paper jam may occur.

On the other hand, the control device 110 controls the drive unit 80 such that the guide surface inclination angle is a second inclination angle B2 (see FIG. 3) when the stacking surface inclination angle is larger than the stacking surface angle threshold, based on the detection result of the stacking surface angle detecting sensor 90. Here, the second inclination angle B2 is an angle which is larger than the first inclination angle B1 (B2>B1).

The control device 110 controls the rotary movement of the guide unit 70, based on the detection result of the stacking surface angle detecting sensor 90.

When the stacking surface inclination angle is smaller than the stacking surface angle threshold, the guide unit 70 does not rotationally move, and the guide surface inclination angle remains at the first inclination angle B1. In the state of FIG. 2, the guide surface inclination angle is the first inclination angle B1.

On the other hand, when the stacking surface inclination angle is larger than the stacking surface angle threshold, the guide unit 70 rotationally moves to the direction of an arrow G (see FIG. 3) by using the guide unit fulcrum 70*c* as the center thereof, and the guide surface inclination angle is the second inclination angle B2. In the state of FIG. 3, the guide surface inclination angle is the second inclination angle B2.

Next, an example of a control by the control device 110 will be described.

Figure 4:
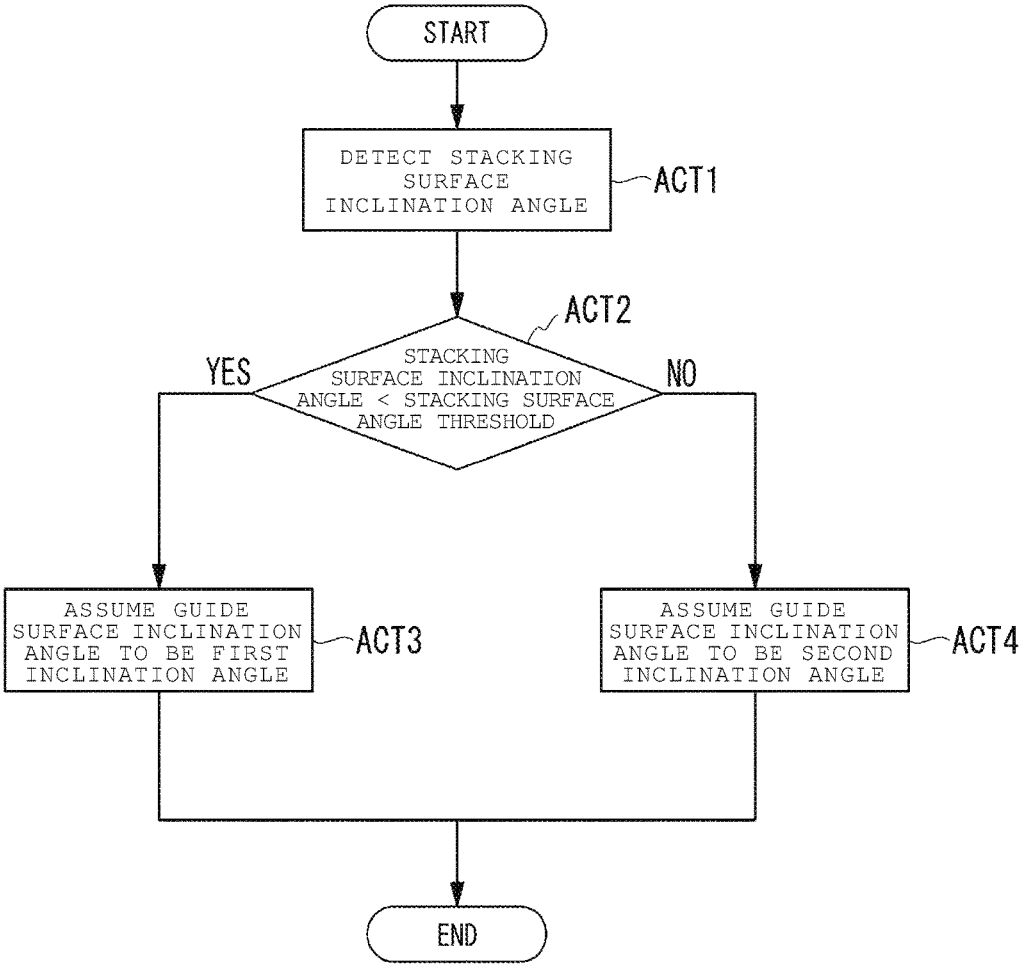
FIG. 4 is a flowchart illustrating an example sequence of control operations according to the embodiment.

FIG. 4 is a flowchart illustrating an example sequence of control operations by the control device 110 according to the embodiment.

As illustrated in FIG. 4, first, the control device 110 detects the stacking surface inclination angle, from the detection result of the stacking surface angle detecting sensor 90 (ACT1).

Next, the control device 110 determines whether or not the stacking surface inclination angle is smaller than the stacking surface angle threshold which is previously set, based on the detection result of the stacking surface angle detecting sensor 90 (ACT2).

In a case where the stacking surface inclination angle is smaller than the stacking surface angle threshold (ACT2: YES), the control device 110 controls the drive unit 80 such that the guide surface inclination angle is the first inclination angle B1 (ACT3). In ACT3, when the stacking surface inclination angle is smaller than the stacking surface angle threshold, the guide unit 70 does not rotationally move, and the guide surface inclination angle remains at the first inclination angle B1.

On the other hand, in a case where the stacking surface inclination angle is larger than the stacking surface angle threshold (ACT2: NO), the control device 110 controls the drive unit 80 such that the guide surface inclination angle is the second inclination angle B2 (ACT4). In ACT4, when the stacking surface inclination angle is larger than the stacking surface angle threshold, the guide unit 70 rotationally moves in the direction of the arrow G (see FIG. 3) using the guide unit fulcrum 70*c*, and the guide surface inclination angle is the second inclination angle B2.

Next, a functional configuration of the image forming apparatus 10 will be described.

Figure 5:
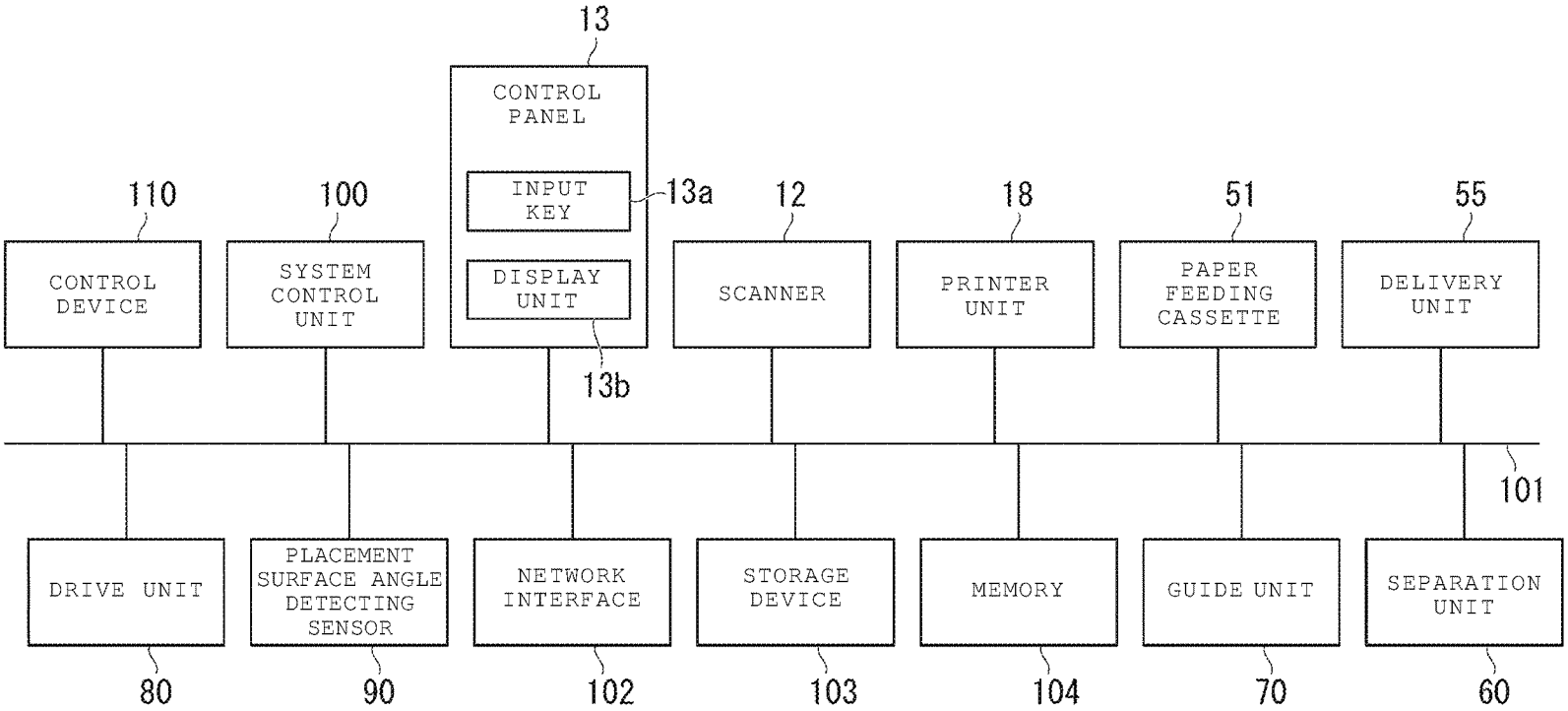
FIG. 5 illustrates an example functional block configuration of the image forming apparatus.

FIG. 5 illustrates an example functional block configuration of the image forming apparatus 10 according to the embodiment.

As illustrated in FIG. 5, the respective functional units of the image forming apparatus 10 are connected to each other such that the data communication is possible through a system bus 101.

The system control unit 100 controls the operation of the respective functional units of the image forming apparatus 10. The system control unit 100 executes various types of processing by executing a software program. The system control unit 100 obtains an instruction input by the user from the control panel 13. The system control unit 100 executes the control processing, based on the obtained instruction.

A network interface 102 performs the communication of the data with other devices. The network interface 102 serves as an input interface, and receives the data sent from other devices. Moreover, the network interface 102 serves as an output interface, and sends the data to other devices.

A storage device 103 stores various types of data. For example, the storage device 103 is a hard disk or a solid state drive (SSD). For example, various types of data are digital data, screen data of a setting screen, the setting information, a job and a job log, and the like. The digital data is the data which is generated by the scanner 12 as an image obtaining unit. The setting screen is a screen for performing the operation setting of the guide unit 70. The setting information is the information relating to the operation setting of the guide unit 70.

A memory 104 temporarily stores the data which is used in the respective functional units. For example, the memory 104 is a random access memory (RAM). For example, the memory 104 temporarily stores the digital data, the job and the job log, and the like.

Next, the operation of the guide unit 70 in accordance with the type of the sheet P will be described.

The system control unit 100 controls the operation of the guide unit 70 in accordance with the type of the sheet P. In a case where the sheet P (referred to as "sheet having low adhesion", hereinafter) is the sheet that is unlikely to adhere when the sheets P are stacked and overlapped, the sheet P is fed without causing the guide unit 70 to operate (see FIG. 2). That is, in a case where the sheet P is the sheet having low adhesion, the pickup roller 56 delivers the plurality of stacked and overlapped sheets P in sequence toward the transport path 33, in the state where the driving of the drive unit 80 is stopped.

On the other hand, in a case where the sheet P (referred to as "sheet having high adhesion", hereinafter) is the sheet that is likely to adhere when the sheets P are stacked and overlapped, the guide surface inclination angle is the second inclination angle B2, by causing the guide unit 70 to operate by the input key 13*a* such as a button (see FIG. 3). For example, in a case where the sheet P is the sheet having high adhesion, the user presses the button, and thereby, the guide unit 70 rotationally moves, and the state may be switched to the state of FIG. 3.

According to one embodiment, a paper feeding method includes a paper feeding step, a separation step, a guide step, and a guide surface angle adjusting step. In the paper feeding step, the sheet P is fed. In the separation step, the plurality of overlapped sheets P are separated from each other in a case where the plurality of sheets P are overlapped in the paper feeding step. In the guide step, the sheet P is guided along the guide surface 70*a* (see FIG. 2). In the guide surface adjusting step, the guide surface inclination angle is changed in accordance with the change of the stacking surface inclination angle.

In the embodiment, the relative angle between the stacking surface inclination angle and the guide surface inclination angle remains at a fixed angle, in the guide surface angle adjusting step.

However, if an inclination unit is configured to be fixed at a fixed position, there is a case where it is not possible to handle the plurality of overlapped sheets P with the inclination unit, due to a friction coefficient between the sheets P, a surface condition of the sheet P or the like.

Here, a surface roughness of the sheet P is included in the surface condition of the sheet P. External factors such as humidity and temperature, static electricity between the sheets P, accommodation time of the stacked sheets, and the like are used as other factors causing the case where it is not possible to handle the plurality of overlapped sheets P with the inclination unit.

If the plurality of overlapped sheets P are transported to the pair of rollers, it may not be possible to separate the plurality of sheets P from each other by the separation roller 62, and the overlapped transport may occur. Hereinafter, a configuration in which an inclination unit 70X is fixed at a fixed position is assumed to be a "comparative example".

Figure 6:
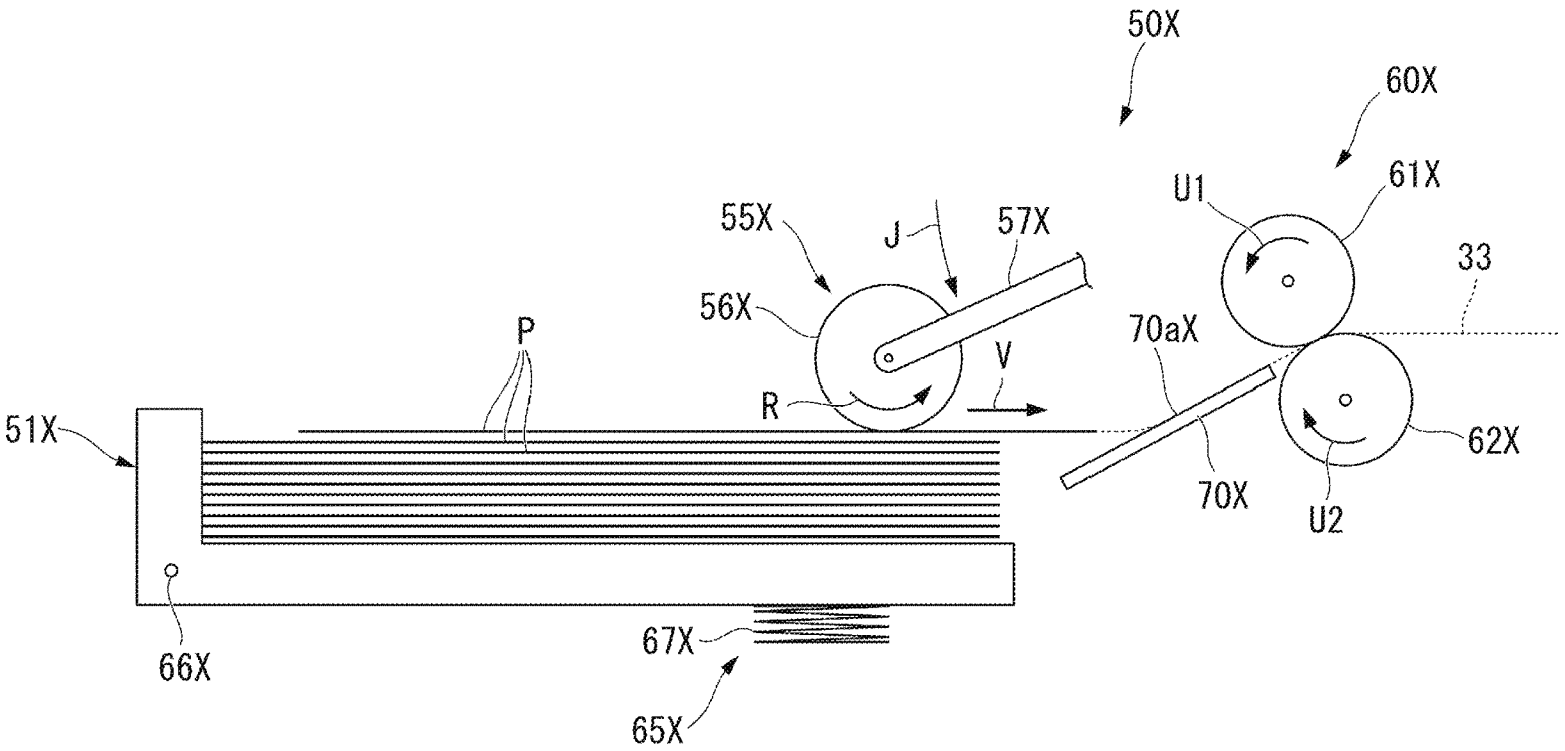
FIG. 6 is a side view illustrating an example configuration of a paper feeding device according to a comparative example.

FIG. 6 is a side view illustrating an example of an outline configuration of a paper feeding device 50X according to the comparative example.

As illustrated in FIG. 6, the paper feeding device 50X according to the comparative example includes a paper feeding cassettes 51X, a delivery unit 55X, a separation unit 60X, a stacking surface tilting unit 65X, and the inclination unit 70X. That is, the drive unit 80, the control device 110 and the like according to the embodiment (see FIG. 2) are not included in the paper feeding device 50X according to the comparative example. The inclination unit 70X has an inclined surface 70*a*X which is inclined upwards on the downstream side in the sheet transport direction V.

A pickup roller 56X is biased to the direction of the arrow J toward the upper surface of the stacked sheets, and rotates in the direction of the arrow R. The pickup roller 56X delivers the plurality of stacked and overlapped sheets P in sequence toward the transport path 33. The plurality of stacked and overlapped sheets P are inclined upward on the downstream side in the sheet transport direction V as much as the upper side, due to the friction coefficient between the sheets P, the surface condition of the sheet P or the like.

If the inclination unit 70X is fixed at the fixed position, an approach angle of the sheet P to the inclined surface 70*a*X is changed in a case where the stacking surface inclination angle is changed. If the approach angle to the inclined surface 70*a*X is too large, the sheet P may be stopped due to friction with the inclined surface 70*a*X, and the paper jam may occur.

Figure 7:
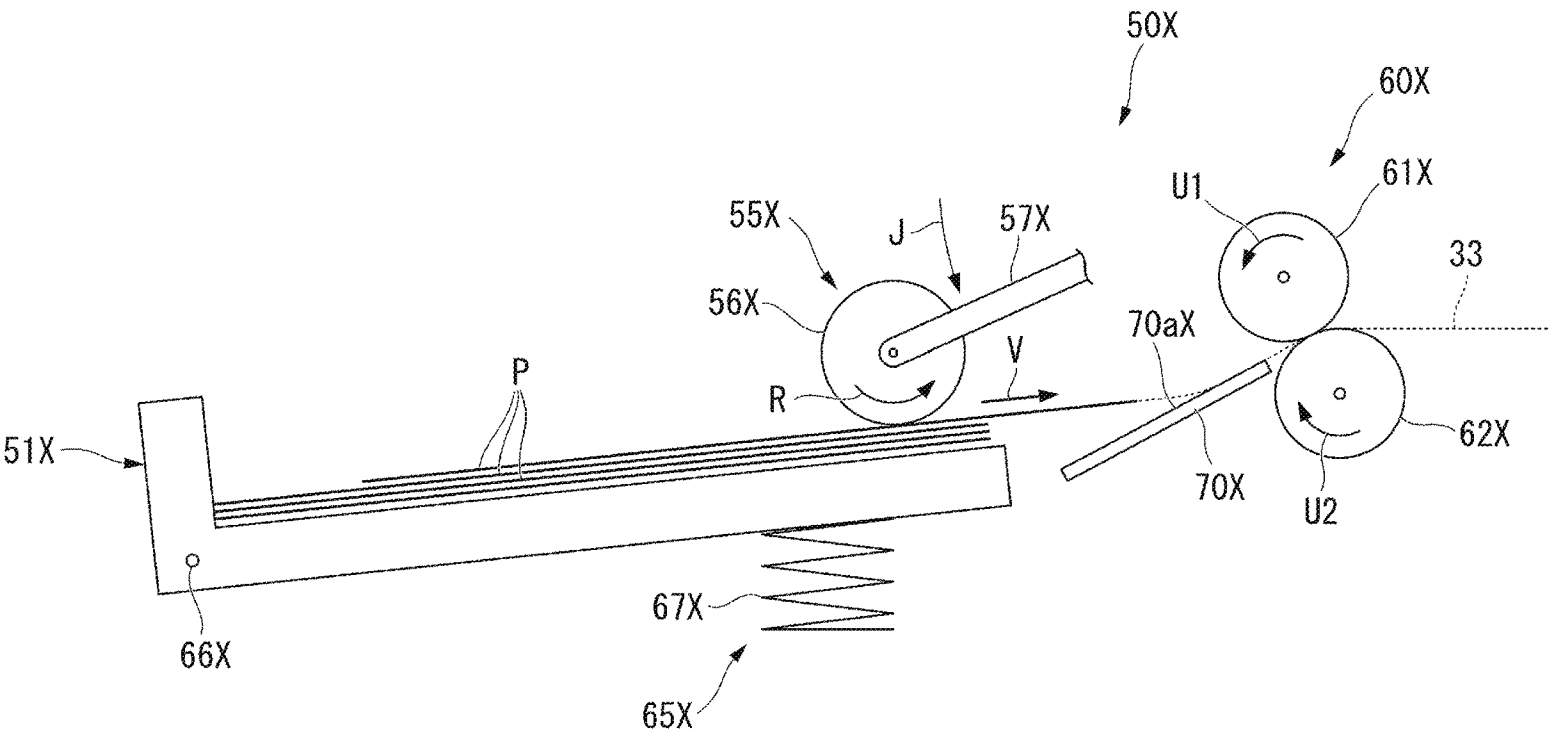
FIG. 7 is another side view of the paper feeding device according to the comparative example illustrating a case where an overlapped transport occurs.

FIG. 7 is a diagram for describing a principle in a case where the overlapped transport occurs.

As illustrated in FIG. 7, if the approach angle to the inclined surface 70*a*X is too small, the frictional force to the sheet P is lowered. Therefore, there is a case where it is not possible to handle the plurality of overlapped sheets P with the inclination unit 70X, due to the friction coefficient between the sheets P, the surface condition of the sheet P or the like. In this case, if the plurality of overlapped sheets P are transported to a pair of rollers 61X and 62X, it is not possible to separate the plurality of sheets P from each other by the separation roller 62X, and the overlapped transport may occur.

According to the embodiment, the paper feeding device 50 includes the delivery unit 55, the separation unit 60, the guide unit 70, the drive unit 80, and the control device 110. The delivery unit 55 delivers the plurality of stacked and overlapped sheets P in sequence toward the transport path 33. The separation unit 60 is arranged downstream from the delivery unit 55 in the sheet transport direction V. The separation unit 60 separates the plurality of overlapped sheets P from each other in a case where the plurality of sheets P delivered from the delivery unit 55 are overlapped. The guide unit 70 is arranged between the delivery unit 55 and the separation unit 60 in the sheet transport direction V. The guide unit 70 has the guide surface 70*a* which is inclined upward on the downstream side in the sheet transport direction V. The drive unit 80 enables to change the inclination angle of the guide surface 70*a*. The control device 110 controls the drive unit 80 so as to change the guide surface inclination angle in accordance with the change of the stacking surface inclination angle. By the above configuration, the following effects are achieved. It is possible to prevent the approach angle to the guide surface 70*a* from being too large, by making the guide surface inclination angle small in a case where the stacking surface inclination angle is small. The approach angle to the guide surface 70*a* is prevented from being too large, and thereby, it is possible to prevent the sheet P from colliding with the guide surface 70*a*, and the paper jam from occurring. On the other hand, it is possible to prevent the approach angle to the guide surface 70*a* from being too small, by making the guide surface inclination angle large in a case where the stacking surface inclination angle is large. The approach angle to the guide surface 70*a* is prevented from being too small, and thereby, it is possible to prevent lowering the frictional force between the guide surface 70*a* and the sheet. Therefore, it is possible to easily separate the plurality of overlapped sheets P from each other in a case where the plurality of sheets P delivered from the delivery unit 55 are overlapped, by the frictional force between the guide surface 70*a* and the sheet. Consequently, it is possible to prevent the overlapped transport from occurring.

From the viewpoint of achieving cost reduction of the sheet P, recycled paper may be used as the sheet P, instead of plain paper. However, in a case where recycled paper is used as the sheet P, since recycled paper has fibers that are short in comparison with plain paper, the recycled paper is likely to be frayed at the end of the sheet. Thus, there is high possibility that the frayed fibers are entangled with each other (i.e., relatively high coefficient of friction between the recycled paper sheets), and are transported in an overlapped manner. According to the embodiment, even in a case where recycled paper is used as the sheet P, since it is possible to easily separate the plurality of overlapped sheets P from each other by changing the guide surface inclination angle, it is possible to further prevent the overlapped transport from occurring.

From the viewpoint of preventing the occurrence of the overlapped transport, the frictional force to the sheet is considered to remain in a high state such that the overlapped transport does not occur. However, in a case where the frictional force to the sheet remains in the high state, in accordance with the type of the sheet P, the sheet P may be damaged. For example, since the frictional force to the sheet is too high in accordance with the type of the sheet P, the downstream end of the sheet P may be bent or broken. According to the embodiment, since it is possible to reduce the frictional force to the sheet by changing the guide surface inclination angle in accordance with the type of the sheet P, it is possible to prevent the sheet P from being damaged.

The guide unit fulcrum 70*c* is positioned close to the separation unit 60, and thereby, the following effects are achieved. Since the separation unit 60 is positioned at the fixed position, it becomes easy to guide the sheet P toward the separation unit 60 by the guide unit 70. In addition, it becomes easy to cause the rotary movement of the guide unit 70 to follow the change of the stacking surface inclination angle, in comparison with a case where the guide unit fulcrum 70*c* is far away from the separation unit 60.

The control device 110 controls the drive unit 80 such that the relative angle between the stacking surface inclination angle and the guide surface inclination angle remains at the fixed angle. By the above configuration, the following effects are achieved. In comparison with a case where the relative angle between the stacking surface inclination angle and the guide surface inclination angle is arbitrarily set, it becomes easy to retain the frictional force of the guide surface 70*a* to the sheet uniformly. Therefore, it is possible to stably prevent the occurrence of the paper jam and the occurrence of the overlapped transport.

The stacking surface angle detecting sensor 90 detects the stacking surface inclination angle. The control device 110 controls the drive unit 80 such that the guide surface inclination angle is the first inclination angle B1 when the stacking surface inclination angle is smaller than the stacking surface angle threshold which is previously set, based on the detection result of the stacking surface angle detecting sensor 90. The control device 110 controls the drive unit 80 such that the guide surface inclination angle is the second inclination angle B2 when the stacking surface inclination angle is larger than the stacking surface angle threshold, based on the detection result of the stacking surface angle detecting sensor 90. By the above configuration, the following effects are achieved. In the situation where the paper jam may occur since the stacking surface inclination angle is small, it is possible to automatically cause the drive unit 80 to operate at the appropriate timing, and to automatically make the guide surface inclination angle small. Therefore, even in the situation where the paper jam may occur since the stacking surface inclination angle is small, it is possible to previously prevent the occurrence of the paper jam. On the other hand, in the situation where the overlapped transport may occur since the stacking surface inclination angle is large, it is possible to control the drive unit 80 to operate at the appropriate timing, and to automatically make the guide surface inclination angle large. Therefore, even in the situation where the overlapped transport may occur since the stacking surface inclination angle is large, it is possible to previously prevent the occurrence of the overlapped transport.

The separation unit 60 includes the pair of rotating bodies 61 and 62 of which at least one independently rotates, and thereby, the following effects are achieved. It is possible to separate the plurality of overlapped sheets P from each other by the pair of rotating bodies 61 and 62, in a case where the plurality of sheets P sent from the guide unit 70 are overlapped. In a case where only two pieces of sheets P are overlapped, it is possible to securely separate two pieces of sheets P from each other by the pair of rotating bodies 61 and 62. For example, in a case where two pieces of sheets P (namely, the first sheet P1 and the second sheet P2) are transported between the paper feeding roller 61 and the separation roller 62, it is possible to transport only the first sheet P1 downstream, by the rotation of the paper feeding roller 61. At that time, the separation roller 62 separates the second sheet P2 from the first sheet P1, by being in contact with the lower surface of the second sheet P2.

According to the embodiment, the paper feeding method includes the paper feeding step, the separation step, the guide step, and the guide surface angle adjusting step. In the paper feeding step, the sheet P is fed. In the separation step, the plurality of overlapped sheets P are separated from each other in a case where the plurality of sheets P are overlapped in the paper feeding step. In the guide step, the sheet P is guided along the guide surface 70*a*. In the guide surface adjusting step, the guide surface inclination angle is changed in accordance with the change of the stacking surface inclination angle. By the above configuration, the following effects are achieved. It is possible to prevent the approach angle to the guide surface 70*a* from being too large, by making the guide surface inclination angle small in a case where the stacking surface inclination angle is small. The approach angle to the guide surface 70*a* is prevented from being too large, and thereby, it is possible to prevent the sheet P from sticking to the guide surface 70*a*, and the paper jam from occurring. On the other hand, it is possible to prevent the approach angle to the guide surface 70*a* from being too small, by making the guide surface inclination angle large in a case where the stacking surface inclination angle is large. The approach angle to the guide surface 70*a* is prevented from being too small, and thereby, it is possible to prevent the frictional force of the guide surface 70*a* to the sheet from being too low. Therefore, it is possible to easily separate the plurality of overlapped sheets P from each other in a case where the plurality of sheets P delivered from the delivery unit 55 are overlapped, by the frictional force of the guide surface 70*a* to the sheet. Consequently, it is possible to prevent the overlapped transport from occurring.

According to the embodiment, in the guide surface angle adjusting step, the relative angle between the stacking surface inclination angle and the guide surface inclination angle remains at a substantially fixed angle. By the above configuration, the following effects are achieved. In comparison with the case where the relative angle between the stacking surface inclination angle and the guide surface inclination angle is arbitrarily set, it becomes easy to retain the frictional force of the guide surface 70*a* to the sheet uniformly. Therefore, it is possible to reliably prevent the occurrence of the paper jam and the occurrence of the overlapped transport.

Hereinafter, modification examples will be described.

First, a first modification example of the embodiment will be described.

The control device 110 is not limited to control the drive unit 80, based on the detection result of the stacking surface angle detecting sensor 90. For example, the control device 110 may control the drive unit 80, based instead on a detection result of a stacking quantity detecting sensor 190. According to the first modification example, the stacking quality detecting sensor 190 is used in place of the placement surface angle detecting sensor 90 in FIG. 5

Figure 9:
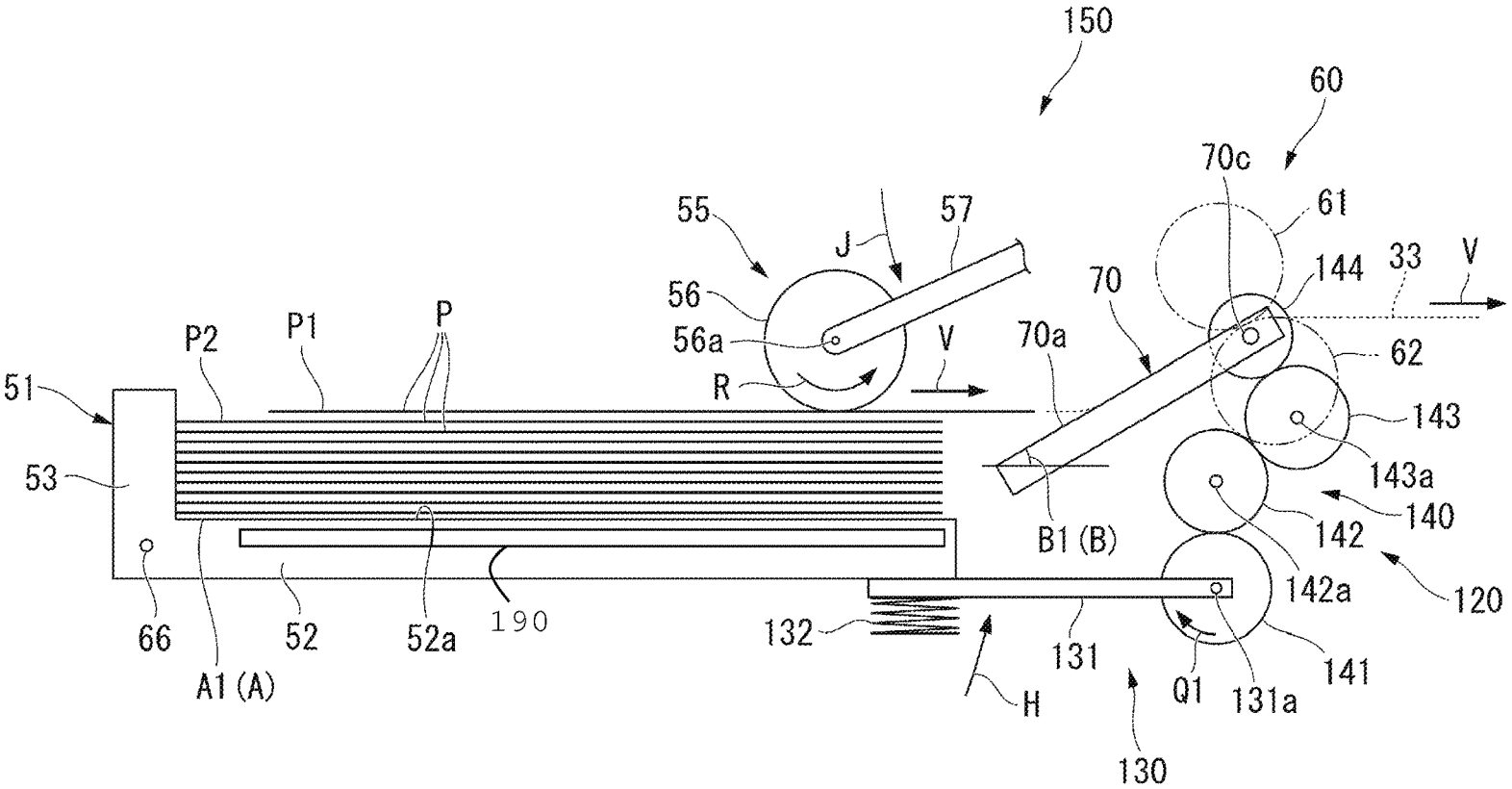
FIG. 9 is a side view of a paper feeding device according to a second modification example of the embodiment.
Figure 10:
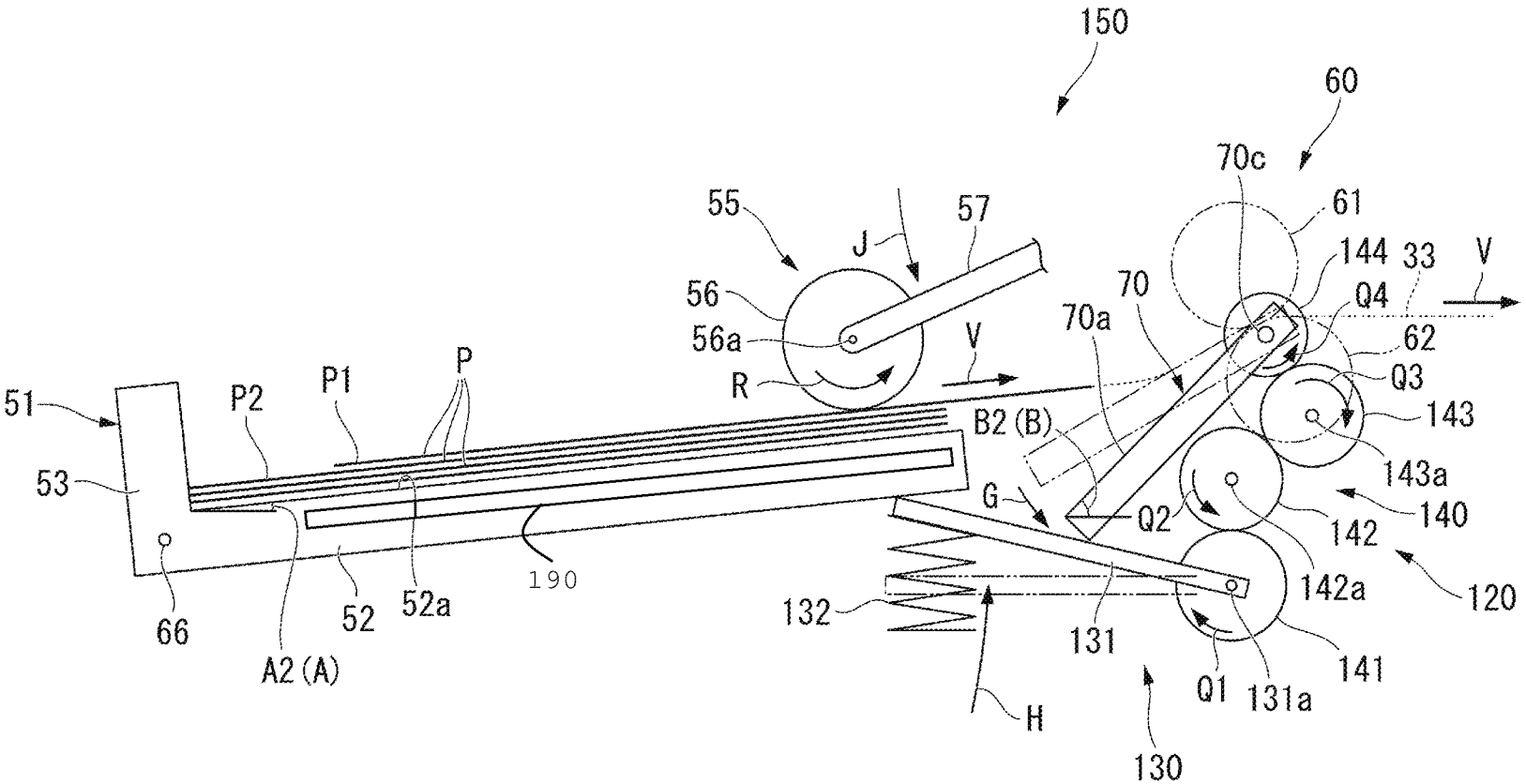
FIG. 10 is another side view of the paper feeding device according to the second modification example of the embodiment illustrating an example operation of a guide unit.

For example, as shown in FIGS. 9 and 10, the stacking quantity detecting sensor 190 is attached to the stacking surface 52*a* of the paper feeding cassette 51. The stacking quantity detecting sensor 190 detects the quantity of the stacked sheets P. For example, the stacking quantity detecting sensor 190 is a weight measuring machine such as an electronic balance.

Figure 8:
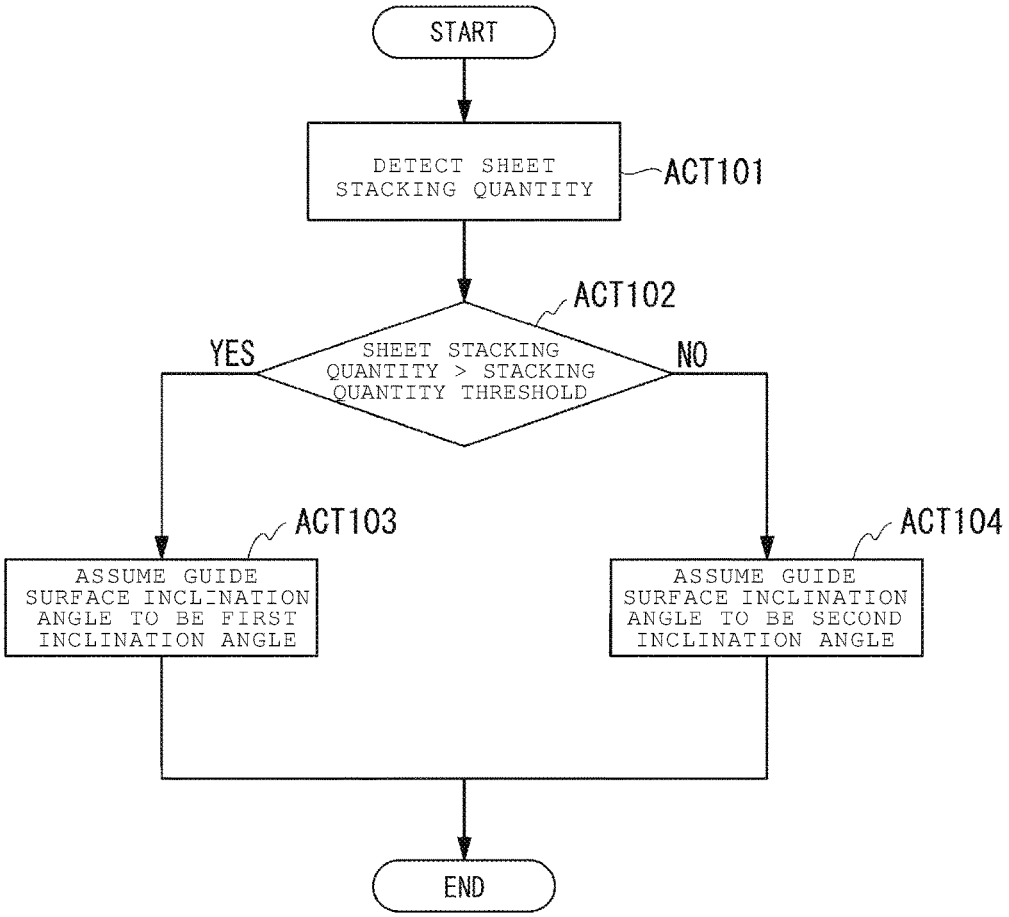
FIG. 8 is a flowchart illustrating an example sequence of control operations according to a first modification example of the embodiment.

FIG. 8 is a flowchart illustrating an example of a control of the control device 110 according to the first modification example of the embodiment.

As illustrated in FIG. 8, first, the control device 110 detects the sheet stacking quantity, from the detection result of the stacking quantity detecting sensor 190 (ACT101).

Next, the control device 110 determines whether or not the sheet stacking quantity is larger than a stacking quantity threshold which is previously set, based on the detection result of the stacking quantity detecting sensor 190 (ACT102).

In a case where the sheet stacking quantity is larger than the stacking quantity threshold (ACT102: YES), the control device 110 controls the drive unit 80 such that the guide surface inclination angle is the first inclination angle B1 (ACT103). In ACT103, when the sheet stacking quantity is larger than the stacking quantity threshold, the guide unit does not rotationally move, and the guide surface inclination angle remains at the first inclination angle B1.

On the other hand, in a case where the sheet stacking quantity is smaller than the stacking quantity threshold (ACT102: NO), the control device 110 controls the drive unit 80 such that the guide surface inclination angle is the second inclination angle B2 (ACT104). In ACT104, when the sheet stacking quantity is smaller than the stacking quantity threshold, the guide unit 70 rotationally moves in the direction of the arrow G (see FIG. 3) using the guide unit fulcrum 70*c* as the center, and the guide surface inclination angle is the second inclination angle B2.

According to the first modification example, in the situation where the paper jam may occur since the sheet stacking quantity is large, it is possible to automatically cause the drive unit 80 to operate at the appropriate timing, and to automatically make the guide surface inclination angle small. Therefore, even in the situation where the paper jam may occur since the sheet stacking quantity is large, it is possible to previously prevent the occurrence of the paper jam. On the other hand, in the situation where the overlapped transport may occur since the sheet stacking quantity is small, it is possible to automatically cause the drive unit 80 to operate at the appropriate timing, and to automatically make the guide surface inclination angle large. Therefore, even in the situation where the overlapped transport may occur since the sheet stacking quantity is small, it is possible to previously prevent the occurrence of the overlapped transport.

Next, a second modification example of the embodiment will be described.

The paper feeding device 50 is not limited to include the drive unit 80 and the control device 110. FIG. 9 is a side view illustrating main units of a paper feeding device 150 according to the second modification example of the embodiment. As illustrated in FIG. 9, the paper feeding device 150 may include a guide surface angle adjusting mechanism 120, instead of the drive unit 80 and the control device 110 illustrated in FIG. 2.

The guide surface angle adjusting mechanism 120 changes the guide surface inclination angle depending on the change of the stacking surface inclination angle. The guide surface angle adjusting mechanism 120 adjusts the guide surface inclination angle between the first inclination angle B1 and the second inclination angle B2. The guide surface angle adjusting mechanism 120 includes a rotary moving mechanism 130, and a rotary movement force transmitting mechanism 140.

First, the rotary moving mechanism 130 will be described.

The rotary moving mechanism 130 rotationally moves depending on the change of the stacking surface inclination angle. The rotary moving mechanism 130 includes an arm 131, and a biasing member 132.

The arm 131 is an elongated member having an longitudinal side extending in one direction. One end of the arm 131 is positioned towards the downstream end of the bottom wall 52 in the paper feeding cassette 51. The other end of the arm 131 is positioned away from the downstream end of the bottom wall 52. At the other end of the arm 131, a rotary movement shaft 131*a* is provided substantially parallel to the support shaft 56*a*. The arm 131 rotationally moves by using the rotary movement shaft 131*a* as the center thereof.

In the second modification example, the biasing member 132 is an elastic member that biases the arm 131. For example, the biasing member 132 is a coil spring. One end of the biasing member 132 is attached to one end of the arm 131. The other end of the biasing member 132 is attached to a surface in the main body (housing) of the MFP 10 (see FIG. 1).

By the biasing member 132, the arm 131 is biased towards the direction of an arrow Q1 (clockwise direction) by using the rotary movement shaft 131*a* as the center thereof. Due to the biasing force of the arm 131, the paper feeding cassette 51 is biased to the direction of the arrow H (counter clockwise direction) by using the rotary movement shaft 66 as the center thereof. The stacking surface inclination angle is changed by the quantity of the sheet P which is placed on the stacking surface 52*a* of the paper feeding cassette 51.

Next, the rotary movement force transmitting mechanism 140 will be described.

The rotary movement force transmitting mechanism 140 transmits the rotary movement force of the arm 131 to the guide unit 70. The rotary movement force transmitting mechanism 140 includes a plurality of rotary moving bodies 141 to 144. In the second modification example, the plurality of rotary moving bodies 141 to 144 are a first rotary moving body 141, a second rotary moving body 142, a third rotary moving body 143, and a fourth rotary moving body 144. The first rotary moving body 141, the second rotary moving body 142, the third rotary moving body 143, and the fourth rotary moving body 144 respectively have cylindrical shapes. For example, the first rotary moving body 141, the second rotary moving body 142, the third rotary moving body 143, and the fourth rotary moving body 144 are rollers made of rubber.

The first rotary moving body 141 is connected to the other end of the arm 131. The first rotary moving body 141, along with the arm 131, rotationally moves by using the rotary movement shaft 131*a* as the center thereof.

The second rotary moving body 142 is arranged on the upper side of the first rotary moving body 141. The second rotary moving body 142 enables to rotationally move by using a second rotary movement shaft 142*a* which is substantially parallel to the support shaft 56*a* as the center thereof. Here, the second rotary movement shaft 142*a* means the central shaft of the second rotary moving body 142. The outer peripheral surface of the second rotary moving body 142 is in contact with the outer peripheral surface of the first rotary moving body 141. The second rotary moving body 142 is a driven roller that is driven in accordance with the rotary movement of the first rotary moving body 141.

The third rotary moving body 143 is arranged between the second rotary moving body 142 and the fourth rotary moving body 144. The third rotary moving body 143 rotationally moves by using a third rotary movement shaft 143*a* which is substantially parallel to the support shaft 56*a* as the center thereof. Here, the third rotary movement shaft 143*a* means the central shaft of the third rotary moving body 143. The outer peripheral surface of the third rotary moving body 143 is in contact with the outer peripheral surface of the second rotary moving body 142. The third rotary moving body 143 is a driven roller that is driven in accordance with the rotary movement of the second rotary moving body 142.

The fourth rotary moving body 144 is arranged above the second rotary moving body 142. The fourth rotary moving body 144 is connected to the other end of the guide unit 70. The fourth rotary moving body 144, along with the guide unit 70, enables to rotationally move by using the guide unit fulcrum 70*c* as the center thereof. The outer peripheral surface of the fourth rotary moving body 144 is in contact with the outer peripheral surface of the third rotary moving body 143. The fourth rotary moving body 144 is a driven roller that is driven in accordance with the rotary movement of the third rotary moving body 143.

Hereinafter, rotary movement directions of the first rotary moving body 141, the second rotary moving body 142, the third rotary moving body 143, and the fourth rotary moving body 144 will be described.

First, a case where the sheet stacking quantity is larger than the stacking quantity threshold will be described. The case where the sheet stacking quantity is larger than the stacking quantity threshold is equivalent to the case where the stacking surface inclination angle is smaller than the stacking surface angle threshold.

In the state of FIG. 9, the sheet stacking quantity becomes larger than the stacking quantity threshold. In the case where the sheet stacking quantity is larger than the predetermined quantity, the paper feeding cassette 51 rotationally moves in the reverse direction (clockwise direction) to the direction of the arrow H by using the rotary movement shaft 66 as the center thereof, against the biasing force of the biasing member 67. The more the sheet stacking quantity is larger than the predetermined quantity, the closer the stacking surface 52*a* of the paper feeding cassette 51 is to the horizontal plane. In the state of FIG. 9, the sheet stacking is the maximum. Therefore, the stacking surface inclination angle A1 is the minimum. In the state of FIG. 9, the stacking surface inclination angle A1 is 0 degree. In the state of FIG. 9, the arm 131 is stopped at the fixed position. Consequently, the first rotary moving body 141, the second rotary moving body 142, the third rotary moving body 143 and the fourth rotary moving body 144 are stopped at the fixed position. The guide unit 70, along with the fourth rotary moving body 144, is stopped at the fixed position.

Next, a case where the sheet stacking quantity is smaller than the stacking quantity threshold will be described. The case where the sheet stacking quantity is smaller than the stacking quantity threshold is equivalent to the case where the stacking surface inclination angle is larger than the stacking surface angle threshold.

In the state of FIG. 10, the sheet stacking quantity becomes smaller than the stacking quantity threshold. As illustrated in FIG. 10, if the sheet stacking quantity is smaller than the stacking quantity threshold, the arm 131 rotationally moves in the direction of the arrow Q1, by the biasing force of the biasing member 132. The first rotary moving body 141, along with the arm 131, rotationally moves in the direction of the arrow Q1.

The second rotary moving body 142 is driven in accordance with the first rotary moving body 141, and rotationally moves in the direction of an arrow Q2. That is, the second rotary moving body 142 is driven and rotationally moves by being in contact with the outer peripheral surface of the first rotary moving body 141 which rotationally moves in the direction of the arrow Q1.

The third rotary moving body 143 is driven in accordance with the second rotary moving body 142, and rotationally moves in the direction of an arrow Q3. In other words, the third rotary moving body 143 is driven and rotationally moves by being in contact with the outer peripheral surface of the second rotary moving body 142 which rotationally moves in the direction of the arrow Q2.

The fourth rotary moving body 144 is driven in accordance with the third rotary moving body 143, and rotationally moves in the direction of an arrow Q4. That is, the fourth rotary moving body 144 is driven and rotationally moves by being in contact with the outer peripheral surface of the third rotary moving body 143 which rotationally moves in the direction of the arrow Q3.

The guide unit 70, along with the fourth rotary moving body 144, rotationally moves in the direction of the arrow G.

According to the second modification example, the following effects are achieved, by including the guide surface angle adjusting mechanism 120 that changes the guide surface inclination angle depending on the change of the stacking surface inclination angle. Since the drive control is not necessary in comparison with the case of including the drive unit 80 and the control device 110, it is possible to mechanically change the guide surface inclination angle in accordance with the change of the stacking surface inclination angle. Therefore, it is possible to easily prevent the occurrence of the paper jam and the occurrence of the overlapped transport.

According to the second modification example, the guide surface angle adjusting mechanism 120 includes the arm 131, and the rotary movement force transmitting mechanism 140. The arm 131 rotationally moves depending on the change of the stacking surface inclination angle. The rotary movement force transmitting mechanism 140 transmits the rotary movement force of the arm 131 to the guide unit 70. By the above configuration, the following effects are achieved. It is possible to easily prevent the occurrence of the paper jam and the occurrence of the overlapped transport, with the simple configuration of using the rotary movement force of the arm 131.

Next, other modification examples of the embodiment will be described.

The guide unit 70 is not limited to have the guide surface 70*a* which is inclined in a straight line shape upward on the downstream side in the sheet transport direction V. For example, the guide unit 70 may have a stepped shape.

By the biasing member 67, the paper feeding cassette 51 is not limited to be biased to the direction of the arrow H (counter clockwise direction) by using the rotary movement shaft 66 as the center thereof. For example, by a drive device such as a motor, the paper feeding cassette 51 may be tilted by using the rotary movement shaft 66 as the center thereof, and the stacking surface inclination angle may be changed.

The plurality of rotary moving bodies 141 to 144 are not limited to the rubber rollers. For example, the plurality of rotary moving bodies 141 to 144 may be gears.

The delivery unit 55 is not limited to deliver the sheet P by the rotation of the pickup roller 56. For example, the delivery unit 55 may deliver the sheet P by belt transport or the like.

In the separation unit 60, the rotating body 62 is not limited to the separation roller 62. For example, a pad may be mounted in replacement of the rotating body 62 (separation roller 62).

According to at least one embodiment of the embodiments described above, the paper feeding device 50 includes the delivery unit 55, the separation unit 60, the guide unit 70, the drive unit 80, and the control device 110. The delivery unit 55 delivers the plurality of stacked and overlapped sheets P in sequence toward the transport path 33. The separation unit 60 is arranged downstream than the delivery unit 55 in the sheet transport direction V. The separation unit 60 separates the plurality of overlapped sheets P from each other in a case where the plurality of sheets P delivered from the delivery unit 55 are overlapped. The guide unit 70 is arranged between the delivery unit 55 and the separation unit 60 in the sheet transport direction V. The guide unit 70 has the guide surface 70*a* which is inclined upward on the downstream side in the sheet transport direction V. The drive unit 80 enables to change the inclination angle of the guide surface 70*a*. The control device 110 controls the drive unit 80 so as to change the guide surface inclination angle in accordance with the change of the stacking surface inclination angle. By the above configuration, the following effects are achieved. It is possible to prevent the approach angle to the guide surface 70*a* from being too large, by making the guide surface inclination angle small in a case where the stacking surface inclination angle is small. The approach angle to the guide surface 70*a* is prevented from being too large, and thereby, it is possible to prevent the sheet P from colliding with the guide surface 70*a*, and the paper jam from occurring. On the other hand, it is possible to prevent the approach angle to the guide surface 70*a* from being too small, by making the guide surface inclination angle large in a case where the stacking surface inclination angle is large. The approach angle to the guide surface 70*a* is prevented from being too small, and thereby, it is possible to prevent the frictional force of the guide surface 70*a* to the sheet from being lowered. Therefore, it is possible to easily separate the plurality of overlapped sheets P from each other in a case where the plurality of sheets P delivered from the delivery unit 55 are overlapped, by the frictional force of the guide surface 70*a* to the sheet. Consequently, it is possible to prevent the overlapped transport from occurring.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper feeding device comprising:

a paper feeding cassette configured to hold one or more sheets on a stacking surface;

a pickup roller configured to feed a sheet from the paper feeding cassette;

at least one separation roller arranged downstream from the paper feeding cassette in a transport direction of the sheet and configured to separate the sheet from another sheet in a case where a plurality of sheets is fed from the paper feeding cassette in an overlapped state;

a guide unit arranged between the paper feeding cassette and the at least one separation roller, the guide unit having a guide surface which is inclined such that a downstream side thereof in the transport direction of the sheet is higher relative to an upstream side thereof in the transport direction of the sheet;

a sensor configured to detect a quantity of sheets stacked on the stacking surface, a drive unit configured to change an angle of the guide surface relative to horizontal; and a control device configured to:

receive the detected quantity of sheets from the sensor; and control the drive unit to change the angle of the guide surface such that, when the detected quantity of sheets is greater than a threshold, the angle of the guide surface is a first predetermined angle, and when the detected quantity of sheets is equal to or smaller than the threshold, the angle of the guide surface is a second predetermined angle which is greater than the first predetermined angle.

2. The paper feeding device according to claim 1, wherein the control device controls the drive unit such that a frictional force between one of the plurality of sheets and the guide surface is within a predetermined frictional force range.

3. The paper feeding device according to claim 1, wherein the sensor is attached to the stacking surface of the paper feeding cassette.

4. The paper feeding device according to claim 3, wherein the sensor is an electronic balance scale.

5. An image forming apparatus comprising:

a paper feeding cassette configured to hold one or more sheets on a stacking surface;

a pickup roller configured to feed a sheet from the paper feeding cassette;

at least one separation roller arranged downstream from the paper feeding cassette in a transport direction of the sheet and configured to separate the sheet from another sheet in a case where a plurality of sheets is fed from the paper feeding cassette in an overlapped state;

a guide unit arranged between the paper feeding cassette and the at least one separation roller, the guide unit having a guide surface which is inclined such that a downstream side thereof in the transport direction of the sheet is higher relative to an upstream side thereof in the transport direction of the sheet;

a sensor configured to detect a quantity of sheets stacked on the stacking surface;

a drive unit configured to change an angle of the guide surface relative to horizontal;

a control device configured to:

receive the detected quantity of sheets from the sensor; and control the drive unit to change the angle of the guide surface such that, when the detected quantity of sheets is greater than a threshold, the angle of the guide surface is a first predetermined angle, and when the detected quantity of sheets is equal to or smaller than the threshold, the angle of the guide surface is a second predetermined angle which is greater than the first predetermined angle;

a printer unit configured to print an image on the sheet fed from the guide unit; and a paper discharging unit configured to discharge the printed sheet.

6. The image forming apparatus according to claim 5, wherein the control device controls the drive unit such that a frictional force between one of the plurality of sheets and the guide surface is within a predetermined frictional force range.

7. The image forming apparatus according to claim 5, wherein the sensor is attached to the stacking surface of the paper feeding cassette.

8. The image forming apparatus according to claim 7, wherein the sensor is an electronic balance scale.

9. A paper feeding method carried out by a paper feeding device, the paper feeding method comprising:

holding one or more sheets on a stacking surface of a paper feeding cassette;

feeding the sheets from the paper feeding cassette with a pickup roller;

separating, by at least one separation roller arranged downstream from the paper feeding cassette in a transport direction of the sheet, the sheet from another sheet in a case where a plurality of sheets is fed from the paper feeding cassette in an overlapped state;

detecting, by a sensor, a quantity of sheets stacked on the stacking surface; and changing, by a drive unit, an angle of a guide surface of a guide unit such that, when the detected quantity of sheets is greater than a threshold, the angle of the guide surface is a first predetermined angle, and when the detected quantity of sheets is equal to or smaller than the threshold, the angle of the guide surface is a second predetermined angle which is greater than the first predetermined angle, wherein the guide surface is inclined such that a downstream side thereof in the transport direction of the sheet is higher relative to an upstream side thereof in the transport direction of the sheet.

10. The paper feeding method according to claim 9, wherein the drive unit is controlled such that a frictional force between one of the plurality of sheets and the guide surface is within a predetermined frictional force range.

11. The paper feeding method according to claim 9, wherein the sensor is attached to the stacking surface of the paper feeding cassette.

12. The paper feeding method according to claim 11, wherein the sensor is an electronic balance scale.

* * * * *